US005975062A

United States Patent [19]

Bonse et al.

[11] Patent Number: 5,975,062

[45] Date of Patent: Nov. 2, 1999

[54] APPARATUS AND METHOD FOR PERIODICALLY CLEANING A CHARCOAL CANISTER AND FOR PERIODICALLY CHECKING LEAK-TIGHTNESS OF A FUEL SYSTEM OF AN INTERNAL COMBUSTION ENGINE

[75] Inventors: Michael Bonse, Düsseldorf; Günter Van De Venne, Mönchengladbach, both of Germany

[73] Assignee: Pierburg AG, Neuss, Germany

[21] Appl. No.: 09/038,430

[22] Filed: Mar. 11, 1998

[30] Foreign Application Priority Data

Mar. 11, 1997 [DE] Germany ..... 197 09 903

[51] Int. Cl.[6] ..... F02M 37/04

[52] U.S. Cl. ..... 123/519; 123/520

[58] Field of Search ..... 123/516, 518, 123/519, 520, 198 D; 60/307, 274

[56] References Cited

U.S. PATENT DOCUMENTS

| | | | |
|---|---|---|---|
| 4,070,828 | 1/1978 | Barres | 60/274 |
| 5,273,020 | 12/1993 | Hayami | 123/520 |
| 5,349,935 | 9/1994 | Mezger et al. | 123/520 |
| 5,411,004 | 5/1995 | Busato et al. | 123/520 |
| 5,450,834 | 9/1995 | Yamanaka et al. | 123/520 |
| 5,635,630 | 6/1997 | Dawson et al. | 123/520 |
| 5,881,700 | 3/1999 | Gras et al. | 123/520 |

FOREIGN PATENT DOCUMENTS

| | | |
|---|---|---|
| 0585527 | 3/1994 | European Pat. Off. . |
| 0750108 | 12/1996 | European Pat. Off. . |
| 3935612 | 5/1990 | Germany . |
| 4328090 | 1/1996 | Germany . |
| 19617386 | 7/1997 | Germany . |
| 55-010081 | 1/1980 | Japan . |
| 9614505 | 5/1996 | WIPO . |

*Primary Examiner*—Thomas N. Moulis
*Attorney, Agent, or Firm*—Ladas & Parry

[57] ABSTRACT

A method and apparatus for periodically air-washing a charcoal canister and for testing leak-tightness of a closed fuel supply system of an internal combustion engine in which a reversible electric air pump is installed in a line connecting the fuel system and the canister to the intake manifold of the engine upstream of the choke valve. In one direction of operation of the pump, ambient air is sucked through the canister and fed to the intake manifold to wash the canister and in the other direction of operation of the pump, air is pumped from above the choke valve in the intake manifold to the fuel system to pressurize the system to check leak-tightness thereof. When the engine is turned off, the pump is shut off and the fuel supply system is connected to the canister.

12 Claims, 1 Drawing Sheet

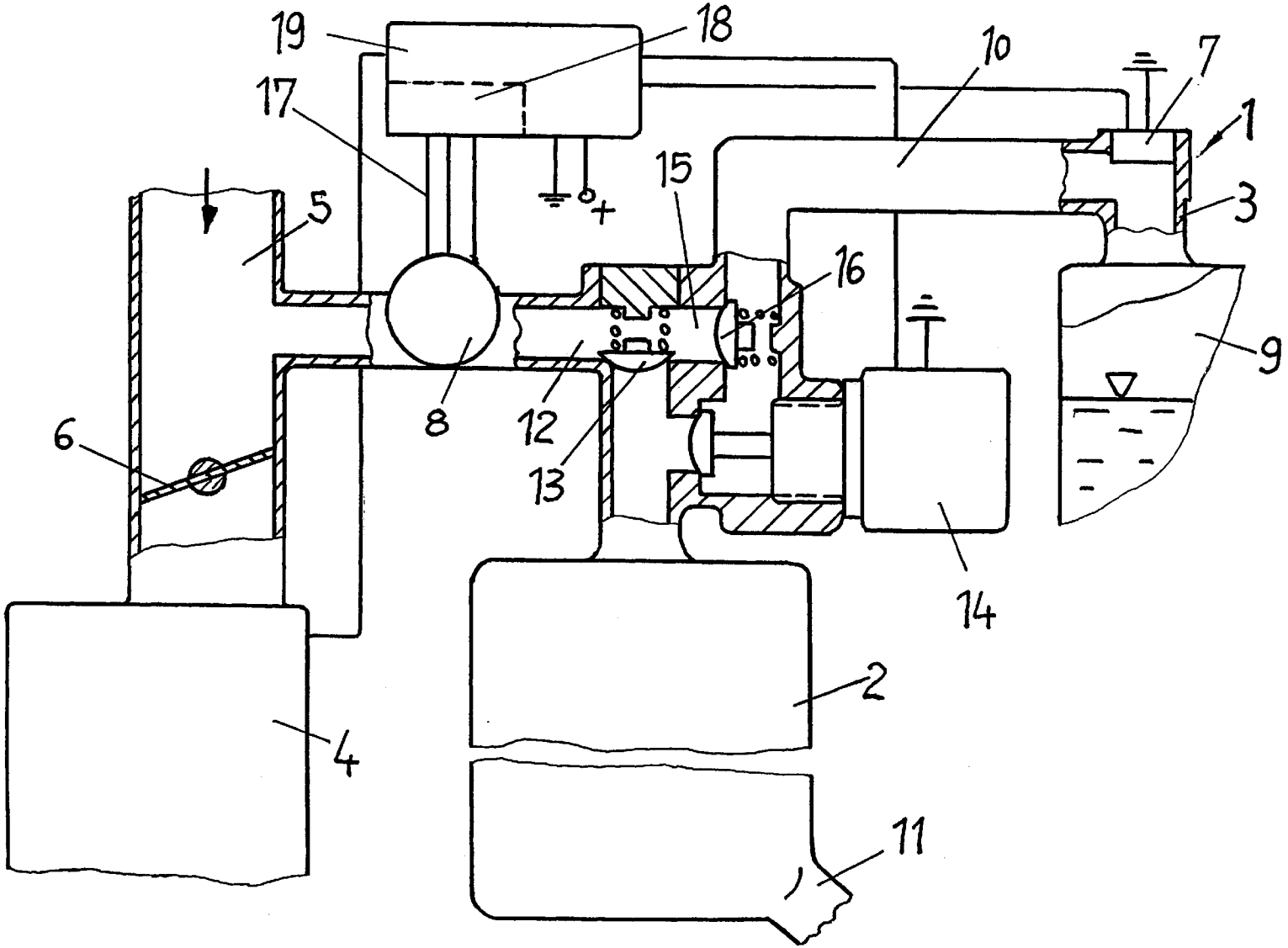
1
3
7
9
10
14
16
15
18
2
11
12
13
8
19
17
5
4
6

APPARATUS AND METHOD FOR PERIODICALLY CLEANING A CHARCOAL CANISTER AND FOR PERIODICALLY CHECKING LEAK-TIGHTNESS OF A FUEL SYSTEM OF AN INTERNAL COMBUSTION ENGINE

FIELD OF THE INVENTION

The invention relates to apparatus and methods for periodically cleaning or purging a charcoal canister and for periodically checking leak-tightness of a fuel tank assembly of an internal combustion engine.

BACKGROUND AND PRIOR ART

Apparatus for cleaning a charcoal canister in an evaporative emission system of an internal combustion engine is disclosed in EPO 585,527 B1. This apparatus consists of a line connecting the charcoal canister to the air intake manifold of the internal combustion engine downstream of a choke device. Thereby, ambient air can be suctioned through the canister to wash the filter therein of trapped fuel vapor and convey the same to the fuel mixture in the intake manifold. Due to fluctuating suction pressures caused by varying engine load, an irregular cleaning is obtained, which is compensated by a time controlled electromagnetic valve. A considerable cost is necessary for technical equipment and control means to operate this apparatus.

In several states in the U.S.A., an automatic monitoring of all exhaust-relevant components of a motor vehicle engine has been required (OBDII). All functions and components of engine control must be regularly monitored for their action and for their effectiveness. In addition to inspecting the ignition system for misfiring and the catalytic converter, it is also necessary to test for leak-tightness of the fuel tank system i.e. the fuel tank and the hoses of the evaporative emission system. This requirement is intended to prevent leakage of fuel vapor, for example, when the vehicle is stopped in the sun and the engine is shut off, due to poor sealing in the hose connections or due to holes in the hoses. Environmental requirements in California make it necessary for the entire fuel tank system to be tested for leak-tightness during every vehicle trip. A 1 mm hole is defined as the identification threshold.

DE 4,328,090 C2 discloses apparatus to apply suction pressure to the tank by means of manifold vacuum via a tank bleeder valve and to measure any increase in suction pressure with a pressure sensor in the tank. Difficulties in this method, arise firstly from different fuel levels in the tank which must be taken into consideration in the evaluation algorithm, and secondly, because leak-tightness testing with the suction in the intake manifold has the additional disadvantage that in order to evacuate the tank, fuel vapors must be drawn into the intake manifold via the tank bleeder valve. During travel, the fuel in the tank heats up due to injection valve operation and tends to build up fuel vapors and increased pressure. Therefore, leak-tightness testing should occur when starting a cold engine, in order to avoid measurements with distorted values due to the heated fuel. The utilization of this process is thus not suitable for testing in the case of a hot engine.

A proposal is known from PCT-WO96/14505, in which a diaphragm pump, which is driven by suction in the intake manifold, pressurizes the tank system, whose pressure drop is measured after turning off the diaphragm pump to determine lack of leak-tightness. This publication, however, also discloses aspirating the cleaning air into the suction region of the air intake system, which has the disadvantage mentioned above of irregular feed and high costs for technical equipment and control means.

SUMMARY OF THE INVENTION

An object of the invention is to provide apparatus in which the charcoal canister is cleaned independently of fluctuating intake pressure of the internal combustion engine, and additionally, an advantageous leak-tightness testing of the fuel tank system can be effected.

In accordance with the invention, an apparatus is provided having a line connected to the air intake manifold upstream of the choke valve therein, and a reversible electric air pump is provided in said line, said canister being connected to said line so that in one direction of pumping by said air pump, ambient atmospheric air flows through said canister to clean the filter therein and convey the air and fuel vapor mixture to the air intake manifold, said fuel tank system being connected to said line for being supplied with air from said intake manifold when said air pump is operated in the other pumping direction to pressurize the fuel tank system while the canister is isolated from said line and said fuel tank assembly.

In further accordance with the invention, a method is provided which comprises periodically washing the canister with ambient atmospheric air and periodically checking leak-tightness of the fuel tank system by periodically operating a reversible electrically driven pump in one direction of operation to draw ambient atmospheric air through the charcoal canister to wash the filter, and periodically operating the electrically driven pump in an opposite pumping direction to pressurize the fuel tank system to determine leak-tightness of said system.

BRIEF DESCRIPTION OF THE DRAWING

The sole FIGURE of the drawing is a diagrammatic illustration of one embodiment of the invention.

DETAILED DESCRIPTION

The drawing shows a device 1 according to the invention for cleaning a charcoal canister 2 of an evaporative emission system of an internal combustion engine 4 of a motor vehicle and for periodically testing leak-tightness of a fuel tank unit 3 of a closed fuel system of the internal combustion engine. The charcoal canister includes an activating carbon filter to trap fuel vapor coming from the head space of the closed fuel tank as well known in the art. In order to clean the charcoal canister 2, air is drawn in from the ambient atmosphere and is passed through the filter in the canister to wash the filter of trapped fuel vapor and convey the air-fuel mixture to an air intake manifold 5 upstream of a choke valve 6; testing of leak-tightness is obtained by establishing a test pressure in the hermetically sealed tank unit 3 after which measurement of any decrease in pressure, is detected by a pressure sensor 7 over a time interval, to provide information on leak-tightness.

According to the invention, the cleaning air for washing the filter in canister 2 is obtained from the ambient atmosphere and flows through the canister 2 to the air intake manifold 5 upstream of choke valve 6, the cleaning air being pumped by an electric air pump 8, whose pumping direction is reversed during leak-tightness testing of the fuel tank system. The air pump 8 is constructed, for example, as a side-channel pump, whose direction of pumping can be reversed.

The fuel tank 9 is connected by means of a first ventilation line 10 to the charcoal canister 2 which has a connection 11 to the ambient atmosphere, when the internal combustion engine is turned off. Thereby, any vapors in the fuel tank system will be trapped in canister 2. The canister 2 is also connected by a cleaning or rinsing line 12 containing electrical air pump 8 and by the pump to the air intake manifold 5 when the internal combustion engine is running. In the rinsing line 12 between charcoal canister 2 and air pump 8, a suction valve 13 is located which closes in the direction of canister 2 and an electrically operated on-off valve 14 is arranged in ventilation line 10. Ventilation line 10 is connected to rinsing line 12 upstream of on-off valve 14 and downstream of suction valve 13, by a connection line 15, which bypasses charcoal canister 2. A pressure valve 16 is disposed in line 15 and opens in the direction of tank unit 3, when the pumping direction of air pump 8 is reversed and on-off valve 14 is closed and the internal combustion engine is running, whereby air for testing leak-tightness is transported from the air intake manifold 5 via the opened pressure valve 16 directly into the tank unit 3, suction valve 13 being closed by the pressure produced by the air pump. When a predetermined pressure difference, relative to atmospheric pressure, is reached, air pump 8 will shut off and the pressure produced will be measured over a predetermined time interval and evaluated for establishing whether tank unit 3 is leak-tight or not.

It is advantageously provided that the predetermined time interval or the pressure decrease is variable for the leak-tightness testing as a function of the fuel filling level as detected and evaluated by a potentiometer of a fuel level indicator (not shown).

The pump 8 is connected by electric lines 17 to a programmed control unit 18 of an electronic control device 19 which carries out the following operations:

turns off air pump 8 and switches on-off valve 14 to open position, when the internal combustion engine is turned off, switches air pump 8 to exhaust and on-off valve 14 to open position, when the internal combustion engine is running, switches air pump 8 to pump air from the intake manifold to tank unit 3 and closes on-off valve 14, when the internal combustion engine is running and a tank leak-tightness test begins, turns off air pump 8 when a predetermined pressure difference is reached, and after establishing whether tank unit 3 is leak-tight or not, and then reverses air pump 8 in the direction to pump air to the intake manifold and opens on-off valve 14 to suction air through canister 2 to clean the filter with ambient air and purge the fuel tank system 3.

A pressure reduction is produced in tank unit 3 by the opened on-off valve 14. In the exhaust phase, and exhaust of fuel vapors from tank unit 3 (closed relative to the atmosphere) is produced simultaneously with the opening of on-off valve 14. Advantageously, cleaning of the charcoal canister is produced only during high load of the internal combustion engine or with a relatively small amount of suction air so that the cleaning air is relatively minor in the fuel mixture, whereby the cleaning operation can be produced only over a predetermined, recurring time interval.

Determining whether tank unit 3 is leak-tight or not can be stored as a diagnostic value in control device 19, and can also be indicated acoustically and/or visually on a display.

A cleaning of the charcoal canister can be achieved by the apparatus of the invention independently of the fluctuating suction in the air intake system and leak-tightness testing can be produced independently of the fuel temperature in the tank system.

The device can be constructed and operated at relatively low cost.

Although the invention is disclosed with reference to a particular embodiment thereof, it will become apparent to those skilled in the art that numerous modifications and variations can be made which will fall within the scope and spirit of the invention as defined by the attached claims.

What is claimed is:

1. Apparatus for cleaning a fuel vapor canister and for testing tightness of a fuel tank unit of an internal combustion engine of a motor vehicle, said engine having an air intake system containing a choke valve, said apparatus comprising:

a line connected to the air intake system upstream of the choke valve, a reversible electric air pump in said line, said canister being connected to said line so that in one direction of pumping by said air pump, ambient atmospheric air flows through said canister to the air intake system to clean the canister, and said fuel tank unit being connected to said line for being supplied with air from said intake system when said air pump is operated in the other pumping direction to pressurize the fuel tank unit while the canister is isolated from said line.

2. Apparatus as claimed in claim 1, comprising a ventilation line between said canister and said fuel tank unit to convey fuel vapor from said fuel tank unit to said canister and therefrom to the ambient atmosphere, when said pump is shut off.

3. Apparatus as claimed in claim 2, comprising valve means for isolating said canister and said fuel tank unit from said pump and said line when the pump is shut off.

4. Apparatus as claimed in claim 3, comprising a bypass line connected to said ventilation line and to said air pump, said valve means comprising a suction valve between said bypass line and said canister, a pressure valve between said bypass line and said ventilation line and an on-off valve in said ventilation line.

5. Apparatus as claimed in claim 4, comprising control means connected to all of said valves and to said reversible pump for operating said pump to pump air from said intake system to said fuel tank unit with said on-off valve closed, said suction valve closed and said pressure valve open, and for turning said air pump off when a predetermined pressure difference, relative to ambient atmospheric pressure, is obtained and measuring pressure drop in a predetermined time period to determine leak-tightness or not of said fuel tank unit.

6. Apparatus as claimed in claim 5, wherein the determination of leak-tightness includes means for measuring fuel level in the fuel tank unit and supplying measurement of fuel level to the control means.

7. Apparatus as claimed in claim 5, wherein said control means is further operative for shutting the air pump and opening said on-off valve when the internal combustion engine is turned off, for reversing the pumping direction of the air pump and opening said on-off valve when the internal combustion engine is running to clean said filter and purge said fuel tank unit.

8. In a method of absorbing, in a charcoal canister, fuel vapor from a closed fuel system of an internal combustion engine, the improvement comprising:

periodically washing the canister with ambient atmospheric air and periodically checking leak-tightness of the fuel system by, periodically operating a reversible electrically driven pump in one direction of operation to force ambient atmospheric air to flow through the canister to wash the canister, and periodically operating the electrically driven pump in an opposite direction of operation to pressurize the fuel system to determine the leak-tightness of said system.

9. The method as claimed in claim 8, comprising pumping air from upstream of a choke valve in an intake manifold of said engine to pressurize the fuel supply system for leak-tightness determination.

10. The method as claimed in claim 8, comprising suctioning ambient atmospheric air into and through the canister to the intake manifold of the engine during the washing of the canister.

11. The method as claimed in claim 8, comprising closing communication between the fuel supply system and the canister during determination of leak-tightness of the fuel system.

12. The method as claimed in claim 8, comprising providing communication between the fuel system and the canister and shutting the air pump when the internal combustion engine is turned off.

* * * * *